US007465171B2

(12) United States Patent
Miyazaki et al.

(10) Patent No.: US 7,465,171 B2
(45) Date of Patent: Dec. 16, 2008

(54) CONNECTOR

(75) Inventors: Yoji Miyazaki, Tsu (JP); Kenji Okura, Tsu (JP)

(73) Assignee: Panasonic Electric Works Co., Ltd., Osaka (JP)

( * ) Notice: Subject to any disclaimer, the term of this patent is extended or adjusted under 35 U.S.C. 154(b) by 0 days.

(21) Appl. No.: 12/059,052

(22) Filed: Mar. 31, 2008

(65) Prior Publication Data

US 2008/0268723 A1 Oct. 30, 2008

(30) Foreign Application Priority Data

Apr. 24, 2007 (JP) ..... P2007-114518

(51) Int. Cl.
*H01R 12/00* (2006.01)

(52) U.S. Cl. ..... 439/74

(58) Field of Classification Search ..... 439/74, 439/660, 295, 284, 83, 66, 247, 65, 876, 439/95, 931, 342, 884, 70–71, 563, 733.1
See application file for complete search history.

(56) References Cited

U.S. PATENT DOCUMENTS 6,019,613 A * 2/2000 Kataoka et al. ..... 439/83
6,905,345 B2 * 6/2005 Zhang ..... 439/74
7,195,495 B2 * 3/2007 Takano et al. ..... 439/74
2006/0051988 A1 3/2006 Okura et al.
2006/0234525 A1 10/2006 Ookura
2007/0105408 A1 5/2007 Ookura
2007/0161274 A1 7/2007 Tanaka et al.

FOREIGN PATENT DOCUMENTS

JP 2007-80843 3/2007

OTHER PUBLICATIONS

English language Abstract of JP 2007-80843.
U.S. Appl. No. 12/059,147 to Miyazaki et al, which was filed on Mar. 31, 2008.

* cited by examiner

*Primary Examiner*—Edwin A. Leon
(74) *Attorney, Agent, or Firm*—Greenblum & Bernstein, P.L.C.

(57) ABSTRACT

Contact portions of a socket contact and a header contact are pressed and thinned, and sloping steps formed by the process that presses and thins in the socket contact and the header contact are engaged with each other to suppress disengagement of the contacts.

3 Claims, 5 Drawing Sheets

CONNECTOR

BACKGROUND OF THE INVENTION

1. Field of the Invention

The present invention relates to a connector in which paired connector connecting bodies are fitted and coupled to each other, thereby corresponding contacts are connected to each other.

2. Description of the Related Art

A conventional connector used for connection between substrates and the like, including a socket (one of connector connecting bodies) having a housing made of an insulator of synthetic resin or the like to which plural contacts are attached, and a header (the other connector connecting body) similarly having a housing made of an insulator to which plural contacts are attached is known (for example, Japanese Patent Application Laid-open No. 2007-80843). In this connector, the socket and the header are fitted and coupled to each other, so that the corresponding contacts are mutually made contact conductive. Consequently, conductive patterns of the circuit substrates to which the corresponding contacts are connected are electrically connected to each other.

A known type of such a connector includes a bent concave unit in one of two contacts that are mutually made contact conductive and a convex unit formed in the other contact (which is formed on the front surface by pressure from the back surface), being engaged to suppress disengagement (slipping out) of the contacts (for example, Japanese Patent Application Laid-open No. 2007-80843).

In the connector as described in Japanese Patent Application Laid-open No. 2007-80843, however, the contact having a predetermined thickness is bend-formed, and thus there is a limit to reduction in a curvature radius of the bent concave unit. Accordingly, a force of engagement with the convex unit is difficult to increase.

The convex unit is protruded from the surrounding area by being pressed from backward of the contact, and thus only one section of the contact in the center of the band width direction cannot be protruded. Accordingly, an effective width of engagement with the bent concave unit cannot be increased so much. Therefore, the engagement force with the bent concave unit is difficult to increase.

An object of the present invention is to provide a connector that has an increased engagement force between a socket contact and a header contact.

SUMMARY OF THE INVENTION

A connector according to the present invention includes a socket having a socket housing provided with a fitting groove portion, and a socket contact that is attached to the socket housing to be bent in the fitting groove portion and soldered to a conductive pattern of one of circuit substrates; and a header having a header housing provided with a fitting convex portion to be fitted into the fitting groove portion, and a header contact that is attached to the header housing to be bent approximately along outside of the fitting convex portion and soldered to a conductive pattern of the other circuit substrate, and the connector is made electrically conductive by inserting the fitting convex portion of the header into the fitting groove portion of the socket, thereby elastically contacting the socket contact and the header contact, in which contact portions of the socket contact and the header contact are pressed and thinned, and sloping steps that are formed by the process that presses and thins in the socket contact and the header contact are engaged with each other, to suppress disengagement of the contacts.

According to the present invention, a substantially entire section from the sloping step to a distal end of the socket contact is pressed and thinned.

According to the present invention, the sloping steps of the socket contact and the header contact are formed across full widths of the corresponding contacts.

BRIEF DESCRIPTION OF THE DRAWINGS

FIG. 3A is a view seen from inside of the socket and FIG. 3B is a view as seen from outside of the socket;

FIG. 6A is a view seen from inside of the header and FIG. 6B is a view seen from outside of the header;

DETAILED DESCRIPTION OF THE PREFERRED EMBODIMENTS

Figure 1:
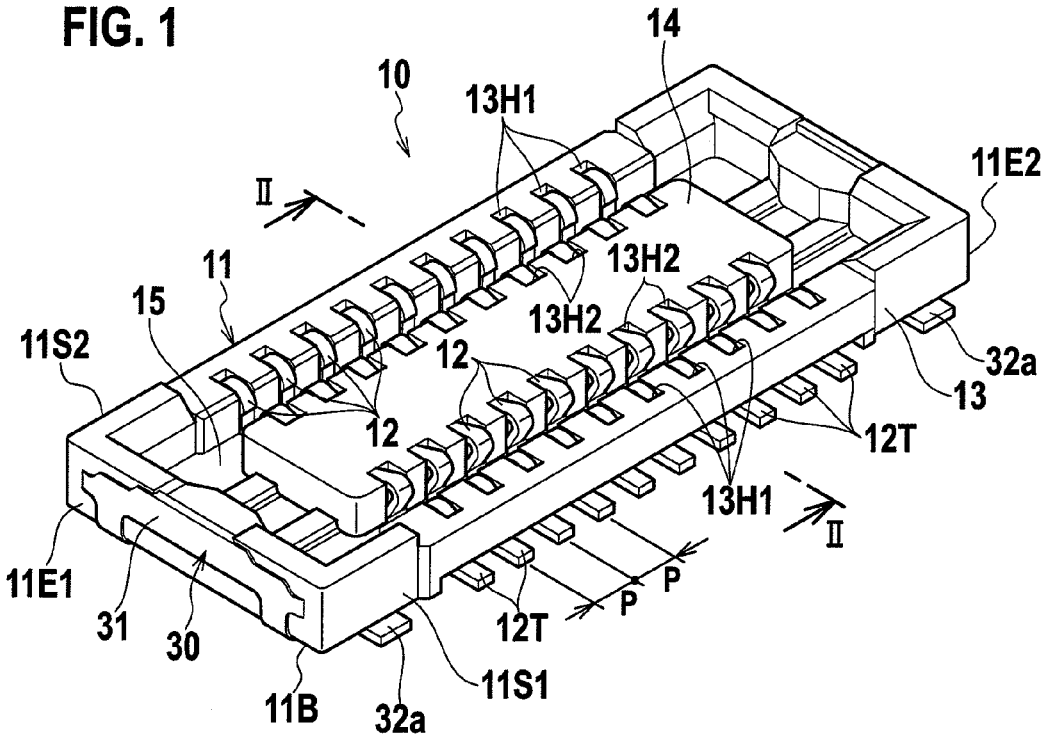
FIG. 1 is an overall perspective view of a socket of a connector according to an embodiment of the present invention.
Figure 2:
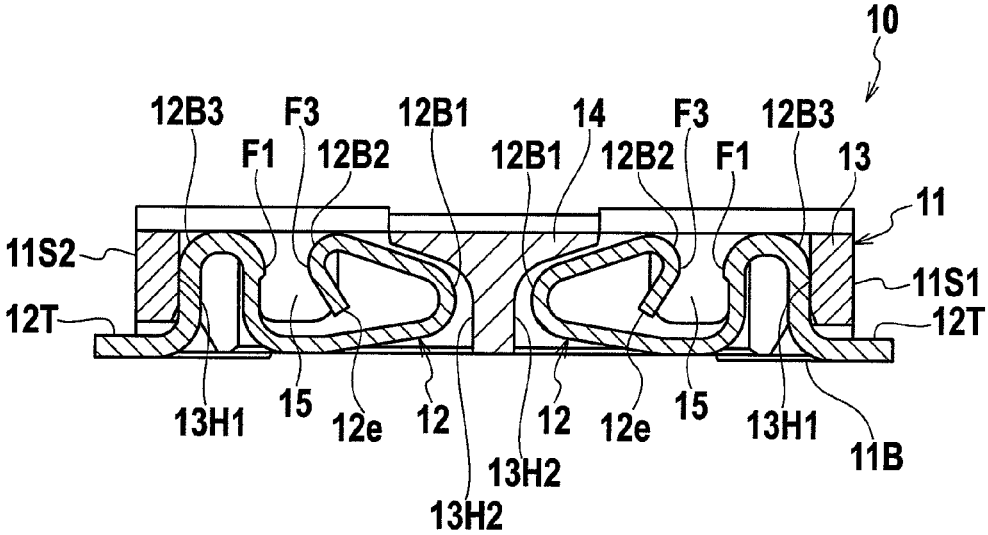
FIG. 2 is a cross section taken along a line II-II in FIG. 1.
Figure 3A:
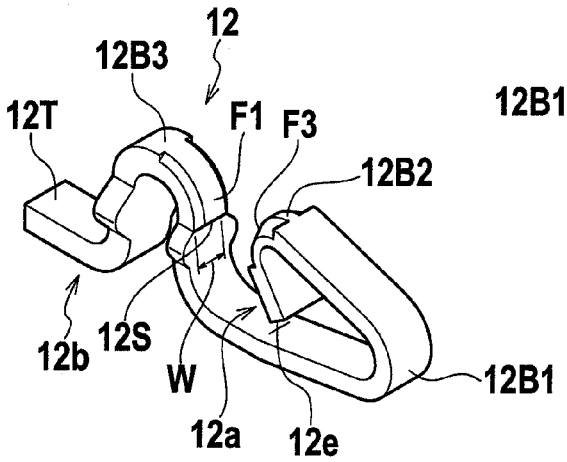
FIGS. 3A and 3B are perspective views of a socket contact included in the socket of the connector according to the embodiment, where
Figure 3B:
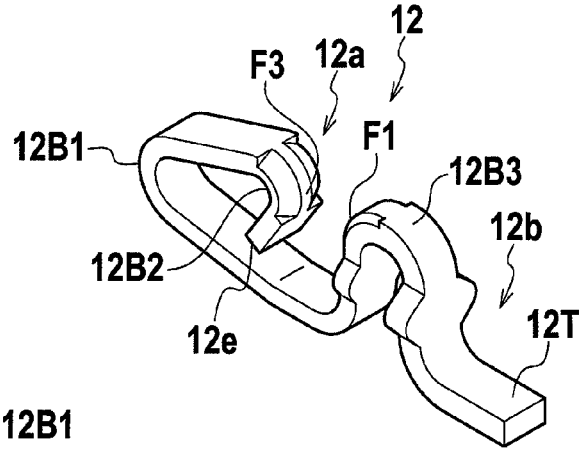
Figure 5:
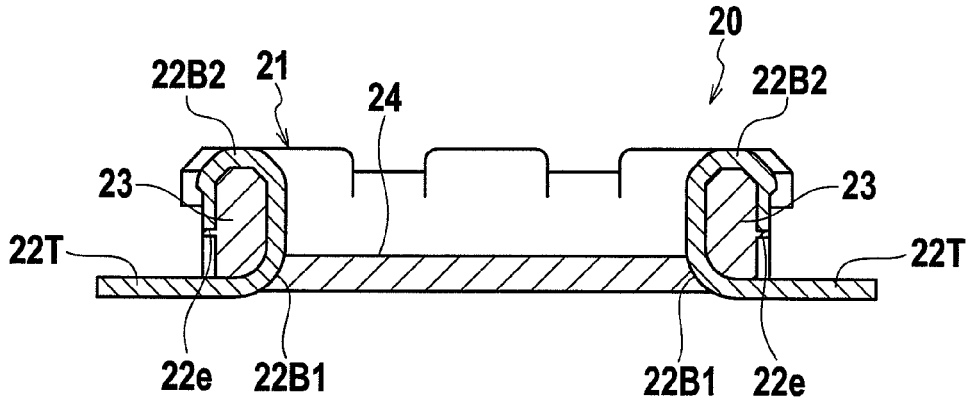
FIG. 5 is a cross section taken along a line V-V in FIG. 4.
Figure 6A:
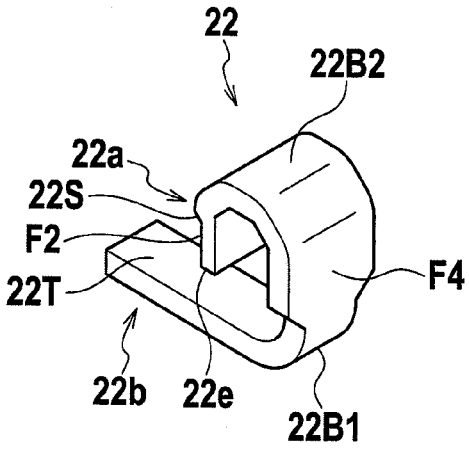
FIGS. 6A and 6B are perspective views of a header contact included in the header of the connector according to the embodiment, where
Figure 6B:
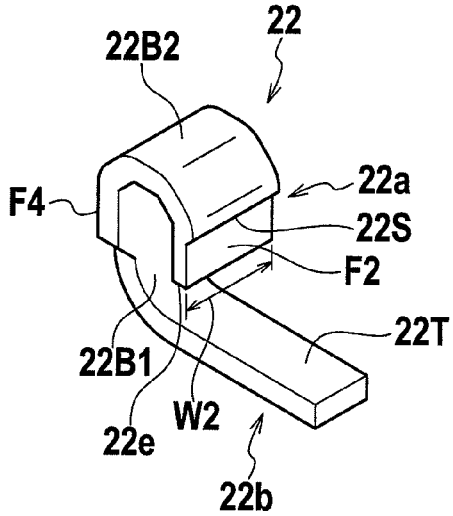

An embodiment of the present invention is explained in detail with reference to the accompanying drawings. FIG. 1 is an overall perspective view of a socket according to the present embodiment, FIG. 2 is a cross section taken along a line II-II in FIG. 1, FIGS. 3A and 3B are perspective views of a socket contact, where FIG. 3A is a view seen from inside of the socket and FIG. 3B is a view seen from outside of the socket, FIG. 4 is an overall perspective view of a header, FIG. 5 is a cross section taken along a line V-V in FIG. 4, and FIGS. 6A and 6B are perspective views of a header contact, where FIG. 6A is a view seen from inside of the header and FIG. 6B is a view seen from outside of the header.

Figure 4:
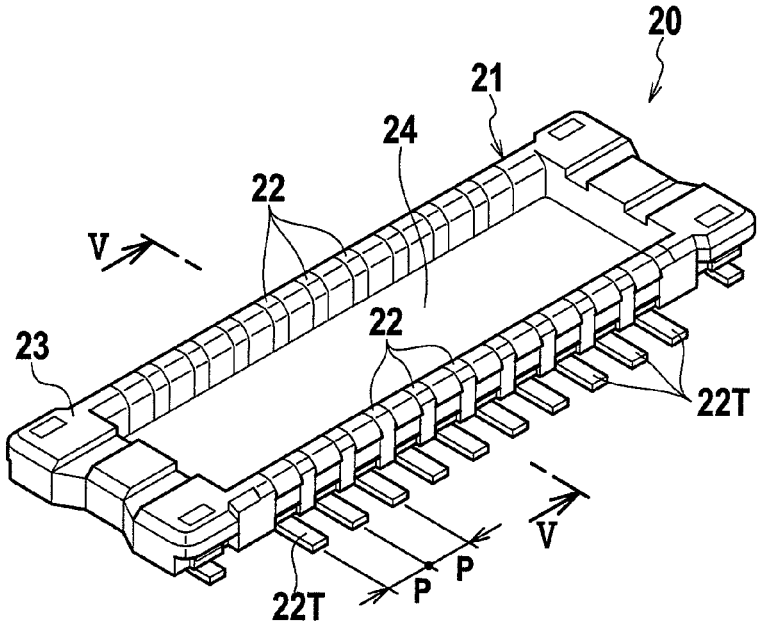
FIG. 4 is an overall perspective view of a header of the connector according to the embodiment.

A connector C according to the present embodiment includes a socket 10 as shown in FIG. 1, which is one of connector connecting bodies, and a header 20 as shown in FIG. 4, which is the other connector connecting body.

The socket 10 includes a socket housing (housing) 11 that is molded of insulating synthetic resin generally in a rectangular shape in top plan, and plural socket contacts 12 that are attached along opposed long sides of the socket housing 11 at a predetermined pitch p, as shown in FIG. 1.

The socket housing 11 includes a peripheral wall 13 that is formed continuously around the periphery of the housing in an approximately rectangular loop, and an approximately rectangular island 14 that is formed in the center of the housing with predetermined clearance from the peripheral wall 13. A fitting groove portion 15 for fitting the header 20 is formed between the peripheral wall 13 and the island 14.

The socket contact 12 is formed by molding of a band-like metallic material having a predetermined thickness in a curved shape, as shown in FIGS. 3A and 3B. An end bent upward from a first bend 12B1 is bent inward, thereby forming a second bend 12B2 on a distal end 12*a* of the socket contact 12. A third bend 12B3 bent in an inverted-U shape is formed on a proximal end 12*b*, and a flat connecting terminal 12T is provided at a distal end of the third bend 12B3.

As shown in FIG. 2, the socket contacts 12 are attached to the socket housing 11 so that the first bends 12B1 protrude into the fitting groove portion 15 in a state where the third bends 12B3 are fitted into recesses 13H1 formed inside the peripheral wall 13 and the second bends 12B2 are fitted into recesses 13H2 formed on a lower surface of the island 14.

In this state, the connecting terminals 12T of the socket contacts 12 protrude outward from a lower edge of the peripheral wall 13. The connecting terminals 12T are soldered to a conductive pattern (printed wiring pattern) of a first circuit substrate (not shown).

Meanwhile, the header 20 includes a header housing 21 that is formed like the socket housing 11 by molding of insulating synthetic resin generally in a rectangular shape approximately similar to the socket housing 11, and plural header contacts 22 that are attached along opposed long sides of the header housing 21 at a pitch p equal to the pitch p of the socket contacts 12, as shown in FIG. 4.

The header housing 21 includes a peripheral wall 23 that is formed continuously around the periphery of the housing in an approximately rectangular loop. An approximately flat bottom wall 24 is formed inside the peripheral wall 23.

As shown in FIGS. 6A and 6B, the header contact 22 is formed by bending a band-like metallic material having a predetermined thickness, like the socket contact 12. An end rising from a fourth bend 22B1 is bent in an inverted-U shape in a retracting direction, thereby forming a fifth bend 22B2 on a distal end 22*a* of the header contact 22. On a proximal end 22*b*, an approximately flat connection terminal 22T is provided.

The header contacts 22 are attached to the header housing 21 so that the fifth bends 22B2 are fitted over the top of the peripheral wall 23 and the proximal ends 22*b* are passed through a lower portion of the peripheral wall 23, as shown in FIG. 5.

In this state, the connecting terminals 22T of the header contacts 22 protrude outward from a lower edge of the peripheral wall 23. The connecting terminals 22T are soldered to a conductive pattern (printed wiring pattern) of a second circuit substrate (not shown).

Figure 7:
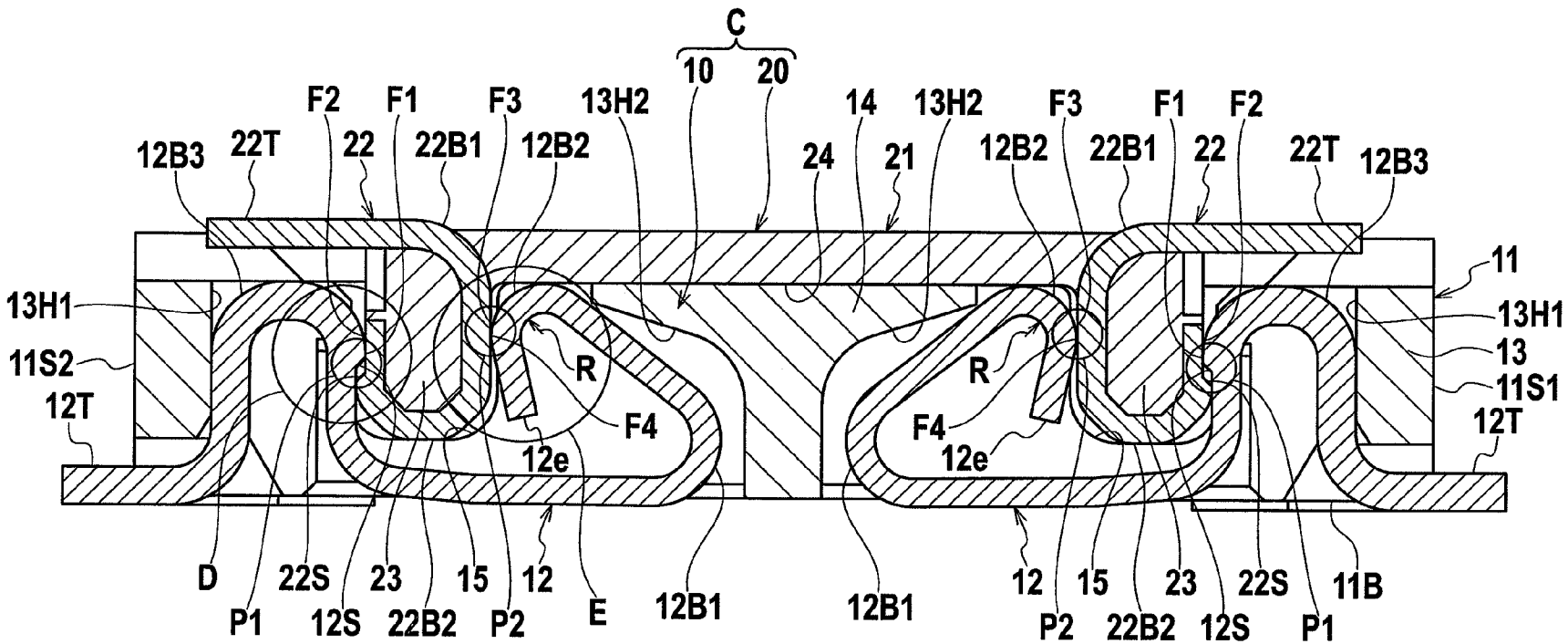
FIG. 7 is a cross section showing a state in which the socket and the header of the connector according to the embodiment are fitted.

FIG. 7 is a cross section showing a state in which the socket and the header are fitted. As shown in FIG. 7, the peripheral wall 23 of the header housing 21 as a fitting convex portion is fitted into the fitting groove portion 15 of the socket housing 11. At this time, an outer surface F1 (see FIGS. 3A and 3B) of the third bend 12B3 of the socket contact 12 on the side of the distal end 12*a* is elastically contacted with an outer surface F2 (see FIGS. 6A and 6B) of the fifth bend 22B2 of the header contact 22 on the distal end 22*a*. In addition, an outer surface F3 (see FIGS. 3A and 3B) of the second bend 12B2 of the socket contact 12 is elastically contacted with a flat outer surface F4 (see FIGS. 6A and 6B) between the fourth bend 22B1 and the fifth bend 22B2 of the header contact 22. Accordingly, the socket contact 12 and the header contact 22 are electrically connected to each other. Consequently, the conductive pattern of the first circuit substrate and the conductive pattern of the second circuit substrate are electrically connected to each other.

As shown in FIG. 1, fitting metals 30 are mounted on both ends of the socket housing 11 in the direction of the long sides. Attachment pieces 32*a* of the fitting metals 30 are soldered to the first circuit substrate, which tightly couples the socket 10 to the first circuit substrate, combined with the soldering of the connecting terminals 12T of the socket contacts 12.

Figure 8:
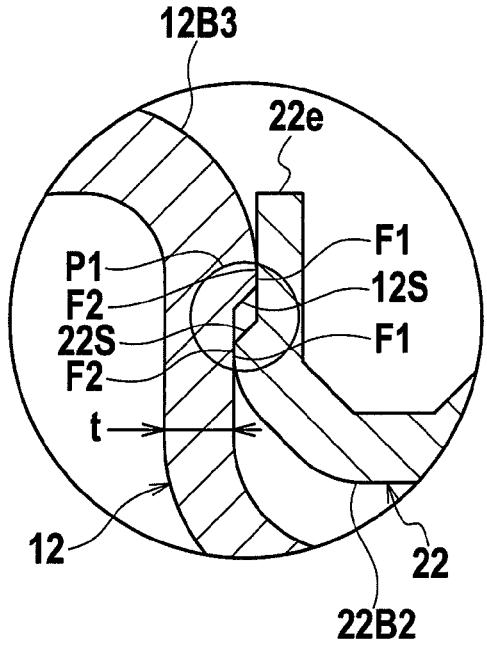
FIG. 8 is an enlarged cross section of a portion D in FIG. 7.

FIG. 8 is an enlarged cross section of a portion D in FIG. 7. As shown in FIGS. 8, 3A, 3B, 6A, and 6B, according to the present embodiment, corresponding contact portions of the socket contacts 12 and the header contacts 22 are pressed and thinned to form sloping steps 12S and 22S (forming by compression). The sloping steps 12S and 22S are engaged with each other to suppress disengagement between the socket contacts 12 and the header contacts 22. Specifically, the sloping steps 12S and 22S are placed opposing each other, with a small space therebetween in the vertical direction. Opposing surfaces of the sloping steps 12S and 22S are inclined in a direction that allows relative sliding so that the contacts 12 and 22 can slip out of each other.

In the present embodiment, as shown in FIG. 7, between the socket contacts 12 and the header contacts 22, there are outer contact portions P1 between F1 and F2 and inner contact portions P2 between F3 and F4. The sloping steps 12S and 22S are provided only in the outer contact portions P1. That is, the outer surface F1 of the third bend 12B3 of the socket contact 12 on the side of the distal end 12*a*, and the outer surface F2 of the fifth bend 22B2 of the header contact 22 on the distal end 22*a* are pressed and thinned.

In the socket contact 12, a substantially entire section from the sloping step 12S to the distal end 12*e* is pressed and thinned. Similarly in the header contact 22, a substantially entire section from the sloping step 22S to the distal end 22*e* is pressed and thinned.

Preferably, the forming by compression to the socket contacts 12 and the header contacts 22 is performed by forging or pressing straight band-like metallic materials, respectively, in a process previous to formation of the first to third bends (12B1 to 12B3) of the socket contact 12 and in a process previous to formation of the fourth and fifth bends (22B1 and 22B2) of the header contact 22. Thereafter, the first to third bends (12B1 to 12B3) and the fourth and fifth bends (22B1 and 22B2) are formed.

As indicated by w1 and w2 in FIGS. 3A and 6B, the sloping steps 12S and 22S of the socket contacts 12 and the header contacts 22 are formed across the full widths of the corresponding contacts 12 and 22.

With this configuration according to the present embodiment, both of the contacts 12 and 22 are pressed and thinned to form the sloping steps 12S and 22S. Accordingly, curvature radiuses of corners (concave portions) or edges (convex portions) of the sloping steps 12S and 22S can be reduced as compared to a case that bending is performed. Thus, the engagement force between the contacts 12 and 22 can be easily increased. Therefore, disengagement of the contacts 12 and 22 can be suppressed more reliably.

According to the present embodiment, the substantially entire section from the sloping steps 12S and 22S to the distal ends 12*e* and 22*e* of the contacts 12 and 22 are hardened to increase the elastic force by the process that presses and thins it. Thus, contact pressure between the contacts 12 and 22 can be increased.

Further, the thickness t of the plate is reduced by the process that presses and thins it, as shown in FIG. 8. Thus, the curvature radius R1 (see FIGS. 7 and 9) can be reduced correspondingly, which contributes to miniaturization of the connector C.

Figure 9:
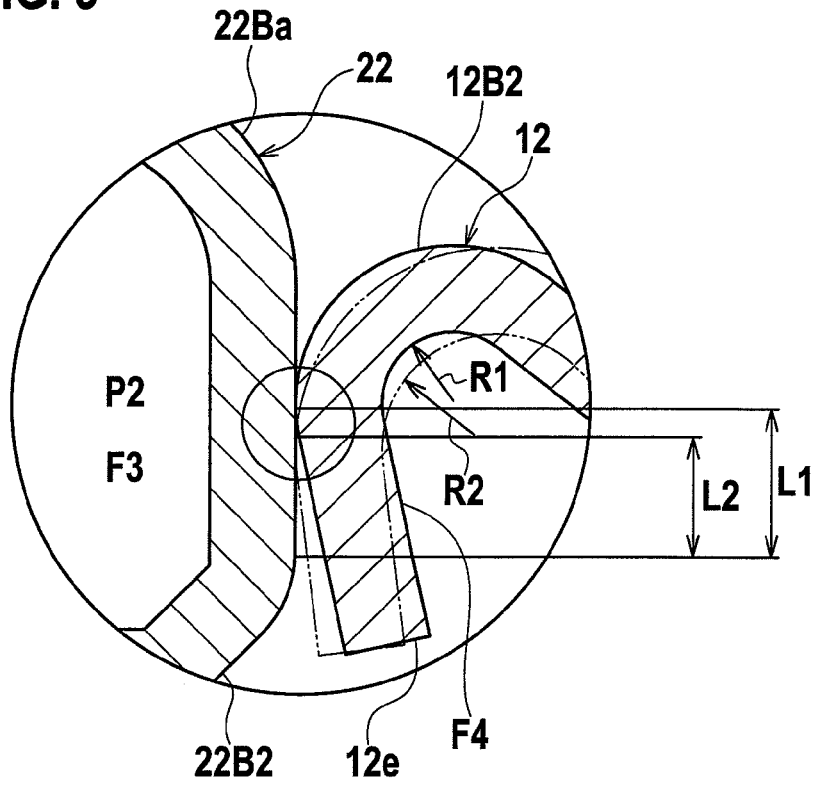
FIG. 9 is an enlarged cross section of a portion E in FIG. 7.

As indicated by solid lines in FIG. 9, which is an enlarged view of a portion E in FIG. 7, a length between a bend ending point of the second bend 12B2 and the distal end 12*e* can be made longer when the curvature radius R1 is smaller. Accordingly, a range in which the contact between the outer surface F3 of the second bend 12B2 and the flat outer surface F4 is allowed (possible), i.e., an allowable fit length between the contacts 12 and 22 becomes L1.

On the other hand, when the process that presses and thins is not performed and the thickness of the socket contacts 12 is larger as indicated by dash-double dot lines in FIG. 9, the curvature radius of the second bend 12B2 is R2 (R2>R1). An allowable fit length in this case is L2 (L2<L1).

Therefore, the allowable fit length L1 can be increased by the process that presses and thins the substantially entire section from the sloping steps 12S to the distal ends 12*e* of the socket contacts 12. Accordingly, formation errors of the socket contacts 12 and the header contacts 22 can be absorbed in a wider range.

According to the present embodiment, the sloping steps 12S and 22S can be formed across the full widths of the contacts 12 and 22 by the process that presses and thins. Thus, an effective engagement width is increased as compared to the case that the contacts are engaged using a convex portion. Accordingly, the engagement force between the contacts 12 and 22 can be easily increased.

Although the preferred embodiment of the present invention has been described above, the present invention is not limited thereto, and various modifications can be made. For example, in the above embodiment, the descriptions have been given of the case that the connector connecting body according to the present invention is embodied as the socket. However, the connector connecting body can be of course embodied as a header. Specifications such as the shape, the size, and the material of the housing, the contact, and the like of the connector connecting body can be properly changed.

What is claimed is:

1. A connector comprising:

a socket having a socket housing provided with a fitting groove portion, and a socket contact that is attached to the socket housing to be bent in the fitting groove portion and soldered to a conductive pattern of one of circuit substrates; and a header having a header housing provided with a fitting convex portion to be fitted into the fitting groove portion, and a header contact that is attached to the header housing to be bent approximately along outside of the fitting convex portion and soldered to a conductive pattern of the other circuit substrate, the connector being made electrically conductive by inserting the fitting convex portion of the header into the fitting groove portion of the socket, thereby elastically contacting the socket contact and the header contact, wherein contact portions of the socket contact and the header contacts are pressed and thinned, and sloping steps that are formed by the process that presses and thins in the socket contacts and the header contacts are engaged with each other, to suppress disengagement of the contacts.

2. The connector according to claim 1, wherein a substantially entire section from the sloping step to a distal end of the socket contact is pressed and thinned.

3. The connector according to claim 1, wherein the sloping steps of the socket contact and the header contact are formed across full widths of the corresponding contacts.

* * * * *